US006527481B1

(12) United States Patent
Mazzo et al.

(10) Patent No.: US 6,527,481 B1
(45) Date of Patent: Mar. 4, 2003

(54) CYLINDRICAL STEEL CORE CAISSON

(75) Inventors: Anthony J. Mazzo, Glendale, NY (US); Leon Levy, Jamaica, NY (US)

(73) Assignee: Urban Foundation/Engineering LLC, East Elmhurst, NY (US)

( * ) Notice: Subject to any disclaimer, the term of this patent is extended or adjusted under 35 U.S.C. 154(b) by 0 days.

(21) Appl. No.: 10/051,812

(22) Filed: Jan. 18, 2002

(51) Int. Cl.[7] ..... E02D 5/30; E04C 3/34

(52) U.S. Cl. ..... 405/231; 405/256; 52/169.13; 52/169.9; 52/301; 52/721.4; 52/737.4; 52/738.1

(58) Field of Search ..... 52/155, 156, 169.13, 52/169.9, 292, 301, 721.1–721.5, 737.3, 737.4, 738.1; 405/229–231, 256, 257

(56) References Cited

U.S. PATENT DOCUMENTS

| | | | | |
|---|---|---|---|---|
| 3,552,787 A | | 1/1971 | Yee | 403/265 |
| 3,955,600 A | | 5/1976 | Tamburello | 138/141 |
| 4,627,212 A | | 12/1986 | Yee | 52/726.1 |
| 4,631,892 A | * | 12/1986 | Beck | 405/239 |
| 6,123,485 A | * | 9/2000 | Mirmiran et al. | 405/232 |
| 6,167,672 B1 | * | 1/2001 | Okitomo | 405/216 |
| 6,197,395 B1 | | 3/2001 | Van Vechten et al. | 428/36.92 |
| 6,309,143 B1 | * | 10/2001 | Merjan et al. | 405/231 |
| 6,382,878 B1 | * | 5/2002 | Yang | 249/144 |

* cited by examiner

*Primary Examiner*—Thomas B. Will
*Assistant Examiner*—Tara L. Mayo
(74) *Attorney, Agent, or Firm*—Salzman & Levy

(57) ABSTRACT

A caisson for use as a support structure in building construction. The caisson has an inner, metallic core and an outer portion surrounding the inner core. Both the inner core and the outer portion are cylindrical. Metallic straps or bands can be disposed peripherally, in spaced apart relation, around the inner core for anchoring it to the outer portion of the caisson. The inner, metallic core is usually steel and the outer portion is concrete or grout. A 22" diameter caisson manufactured in accordance with this invention is capable of supporting more than 2,400 tons. A hollow, cylindrical, steel shell optionally surrounds the outer periphery of the outer portion of the caisson.

19 Claims, 6 Drawing Sheets

CYLINDRICAL STEEL CORE CAISSON

FIELD OF THE INVENTION

The present invention relates to caissons used in construction and, more particularly, to caissons having steel cores.

BACKGROUND OF THE INVENTION

Relatively light buildings can be constructed on packed dirt or stone. In fact, certain structures, such as single-level houses, can be constructed without foundations. Heavier buildings, however, require concrete or steel reinforced concrete foundations and/or footers, preferably disposed on bedrock.

In certain situations, however, the site or portions of a site for a large, heavy building lacks such bedrock. Accordingly, for those situations, holes are often drilled into the ground and concrete caissons are inserted. The caissons form a support structure for the foundation or footers.

Again, for lighter buildings, conventional concrete caissons are adequate to support the building load. However, as the weight of the building increases, the concrete caissons must either increase in diameter or the number of caissons must increase. At a certain point, the size of the caissons becomes unmanageably large. Reinforcing steel or "rebars" have been used to reinforce the concrete. A conventional, reinforced, 24" diameter caisson is rated at 1,300 tons. However, once again, there is a limit to the support strength of even reinforced concrete caissons. Concrete caissons that are reinforced with heavier steel in the form of I-beams and H-beams result in stronger support, but are still inadequate in certain situations.

U.S. Pat. No. 6,197,395, issued to Van Vechten et al on Mar. 6, 2001 for HOLLOW REINFORCING MEMBERS AND COMPOSITES CONTAINING THE SAME, discloses a hollow reinforcing element for casting into composites. Passageways are defined for communicating to the exterior of the composite. These passageways served as conduit arrays in structures formed from the composite. The structure is not used to support a load.

U.S. Pat. No. 4,627,212, issued to Yee on Dec. 9, 1986 for SPLICE SLEEVE FOR REINFORCING BARS WITH CYLINDRICAL SHELL, discloses a splice sleeve for receiving and connecting adjoining ends of a pair of reinforcing bars or rods. The sleeve has an internal surface with ridges that provide a wedging action and compression of grouting introduced into the shell.

U.S. Pat. No. 3,955,600, issued to Tamburello on May 11, 1976 for COMPOSITE PIPELING, discloses a composite pipeline for use in deep water. Once again, the pipeline is hollow and includes a concrete coating integrally bonded to the pipeline. The structure is used as a conduit, rather than a support structure.

U.S. Pat. No. 3,552,787, issued to Yee on Jan. 5, 1971 for WIRE CAGE-TYPE SPLICE SLEEVE FOR REINFORCING BARS, discloses a wire cage splice sleeve for reinforcing bars.

It would be advantageous to provide a concrete caisson with a steel core.

It would also be advantageous to provide a steel core caisson that has greater strength than that provided in conventional reinforced steel core caissons.

SUMMARY OF THE INVENTION

In accordance with the present invention, there is provided a caisson for use as a support structure in building construction. The caisson has a cylindrical, inner, metallic core and a cylindrical outer portion surrounding the inner core, in the preferred embodiment. Metallic bands can be disposed peripherally, in spaced apart relation, around the inner core for anchoring it to the outer portion of the caisson. The inner core of the caisson is at least 29%, and preferably more than 34% of the total cross sectional area of the caisson. The inner, metallic core is usually steel and the outer portion is concrete. A caisson manufactured in accordance with the invention is capable of supporting more than 2,400 tons (22" O.D.) or more than 2,700 tons (24" O.D.). A hollow, cylindrical, steel shell optionally surrounds the outer periphery of the outer portion of the caisson.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

Generally speaking, the invention is a caisson for use as a support structure in building construction. The caisson has a cylindrical, inner, metallic core and a cylindrical outer portion surrounding the inner core, in the preferred embodiment. The inner core of the caisson is at least 29%, and preferably more than 34% of the total cross sectional area of the caisson.

Figure 1:
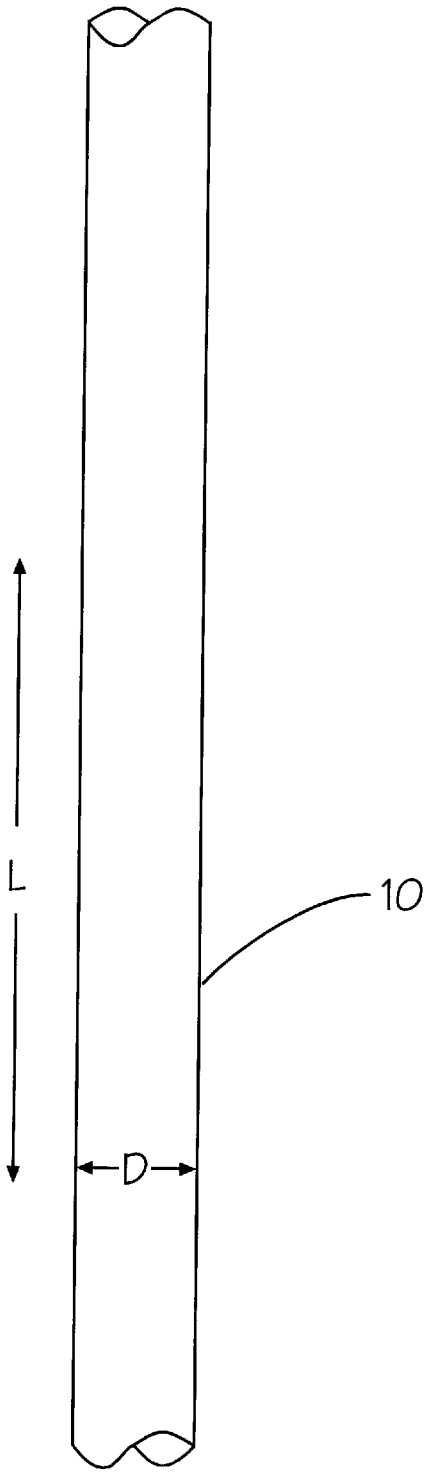
FIG. 1 is a perspective view of the caisson in accordance with the present invention.

Referring now to FIG. 1, there is shown a perspective view of a caisson 10 in accordance with the present invention. The caisson 10 is an elongated cylinder having an outer diameter D, typically 18 inches to 24 inches or larger, standard dimensions for the construction of heavy buildings. The length L of caisson 10 varies depending on the weight of the building and the quality of the soil or rock on which it is disposed. Typically, for a 50-story office building having soil characteristics of 20 TSF rock, the length L of caisson 10 would be approximately 28 feet.

Figure 2:
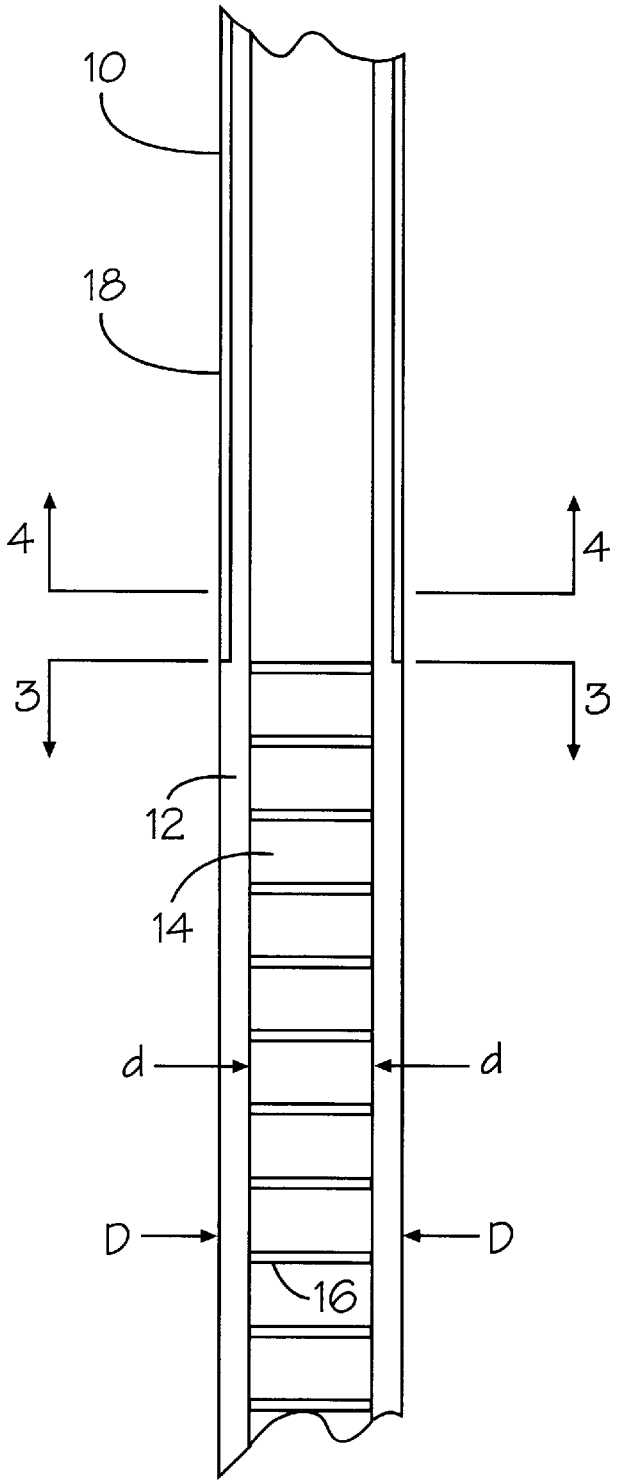
FIG. 2 is a longitudinal cross sectional view of the inventive caisson.

Referring now also to FIG. 2, a longitudinal cross sectional view of caisson 10 is shown. The outer portion of caisson 10 is a cylindrical concrete shell 12 having an outer diameter D, again typically 18 inches to 24 inches or larger. Outer concrete portion 12 surrounds an inner, cylindrical, metallic core 14, having outside diameter d. The preferred metal for inner core 14 is high strength steel or an alloy thereof. The core 14 itself is cylindrically shaped and concentrically disposed with respect to outer concrete portion 12.

Optionally, a plurality of bands or straps 16 can be provided, each of which being in spaced apart relationship (typically 12" on center) to the others, welded around the periphery of core 14, in order to anchor the core 14 to its surrounding concrete 12. Bands or straps 16 are preferably steel, approximately 1" wide.

Alternatively, an outer metallic shell 18 can be disposed around concrete outer portion 12, as shown. Shell 18 can be used with caissons 10 with or without steel bands or rings 16 and may even be used to surround a portion of the caisson 10 only, as shown in FIG. 2.

Figure 3:
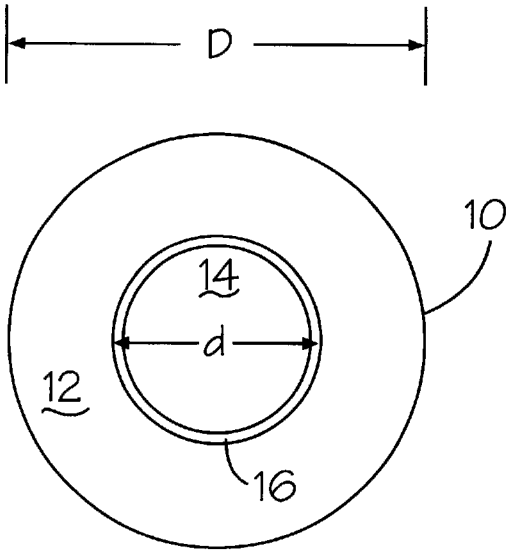
FIG. 3 is a horizontal cross sectional view of the inventive caisson taken along lines 3—3 of FIG. 2.
Figure 3A:
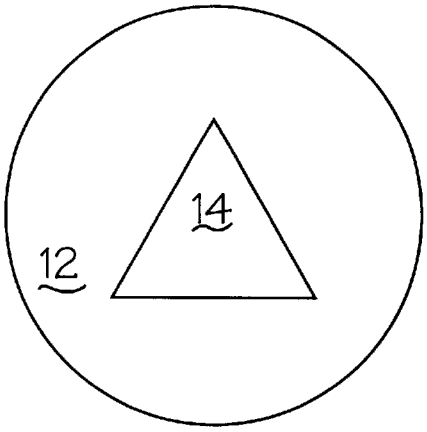
FIGS. 3*a*–3*f* are cross sectional views, respectively, showing different embodiments of the caisson in accordance with the present invention.
Figure 3B:
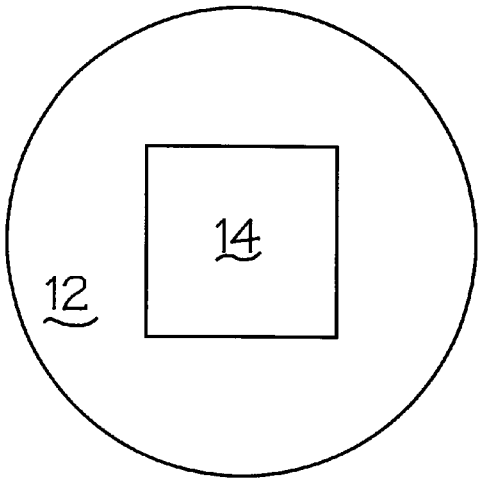
Figure 3C:
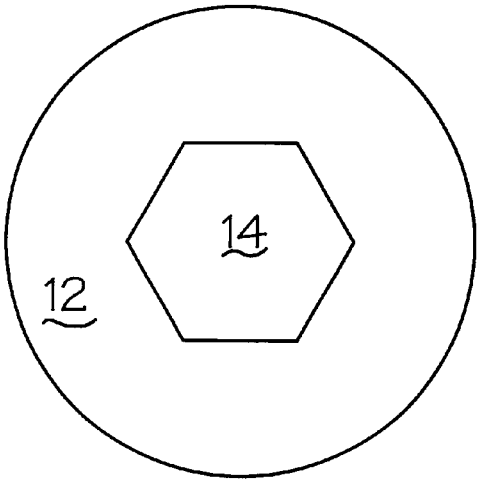
Figure 3D:
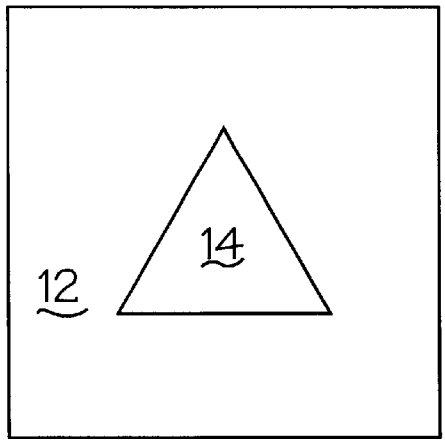
Figure 3E:
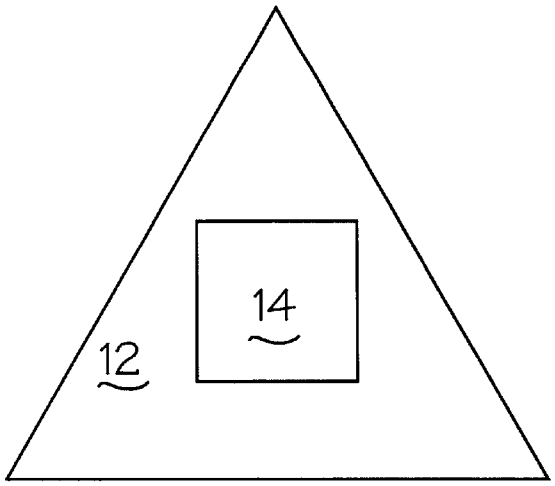
Figure 3F:
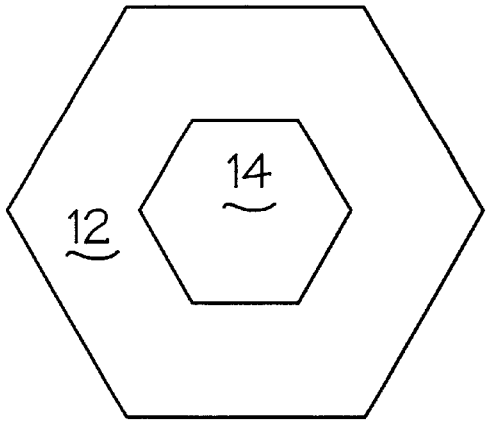

Referring now to FIG. 3, there is shown a horizontal cross section of caisson 10 along lines 3—3 of FIG. 2. Inner metallic core 14 is banded with at least one steel strap 16 which, in turn, is surrounded by concrete 12.

Referring now to FIGS. 3*a*—3*f*, there are shown alternate embodiments of the invention. Specifically, the cross section of the steel core 14 can be any regular or irregular polygon or symmetrical or asymmetrical shape including, but not limited to, a triangle, a square, an ellipse, star, a rhombus, a parallelogram, a hexagon, etc. Moreover, high strength steel in the form of I-beams and H-beams can also yield unexpectedly good results. Suitable billets having predetermined geometric shapes can be used to produce the steel cores 14. The billets themselves are produced by conventional extrusion methods using suitable dies having predetermined geometric shapes. Moreover, the concrete outer portion 12 of the caisson may also have a cross section of any regular or irregular geometry, used in conjunction with the aforesaid core shapes.

Figure 4:
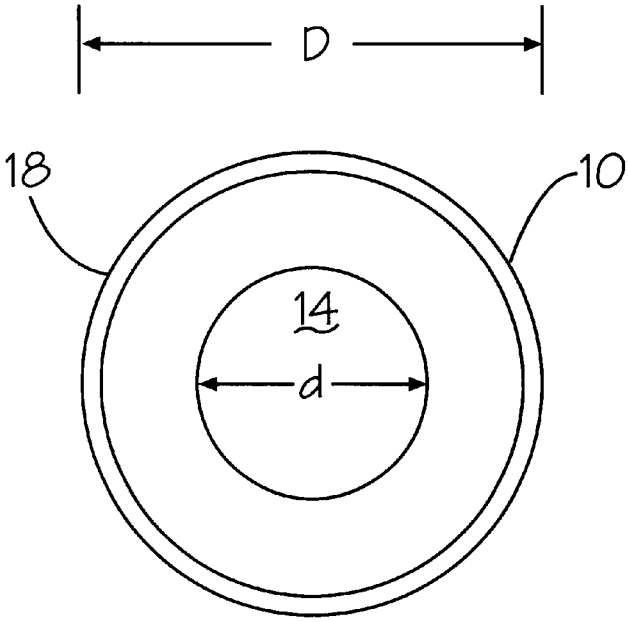
FIG. 4 is a horizontal cross sectional view of an alternate embodiment of the caisson taken along lines 4—4 of FIG. 2 in accordance with the present invention.

Referring now to FIG. 4, there is shown a cross sectional view of caisson 10 in accordance with the present invention, taken along lines 4—4 of FIG. 2. In addition to the aforementioned metallic core 14 and outer concrete portion 12, metallic shell 18 is disposed around the periphery of concrete outer portion 12 of caisson 10. As mentioned above, metallic shell 18 can be used with a caisson 10 having spaced apart straps or bands 16, as well.

While a conventional, reinforced 24" O.D. caisson is capable of supporting about 1,300 tons, it has been found that a caisson with the same dimensions, constructed in accordance with the present invention can support more than twice the load, in excess of 2,700 tons.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A caisson for use as a support structure in building construction, said caisson comprising:

a) a longitudinal and substantially cylindrical, inner, high strength, metallic core; and b) a substantially cylindrical outer portion comprising unreinforced concrete being directly attached to and surrounding said inner, high strength, metallic core;

the cross sectional area of said inner, high strength, metallic core of said caisson being at least 29% of the total cross sectional area and the cross sectional area of said outer portion being less than 71% of said total cross sectional area of said caisson.

2. The caisson in accordance with claim 1, wherein said inner, metallic core comprises high strength steel.

3. The caisson in accordance with claim 1, further comprising a hollow, uninterrupted, cylindrical, steel shell surrounding the outer periphery of said outer portion of said caisson.

4. The caisson in accordance with claim 1, wherein the cross sectional area of said inner, metallic core is over 34% and the cross sectional area of said outer portion is less than 66% of said total cross sectional area of said caisson.

5. A caisson for use as a support structure in building construction, said caisson comprising:

a) a longitudinal and substantially cylindrical inner, metallic core;

b) at least one metallic band disposed peripherally around said inner, metallic core for anchoring said inner, metallic core to an outer portion of said caisson; and c) a substantially cylindrical outer portion surrounding said inner, metallic core and said metallic band and comprising unreinforced concrete, at least a portion of said outer portion being directly attached to and surrounding said inner, metallic core.

6. The caisson in accordance with claim 5, wherein said inner, metallic core comprises steel.

7. The caisson in accordance with claim 5, wherein said at least one metallic band comprises a plurality of spaced apart bands disposed along the length of said inner, metallic core.

8. The caisson in accordance with claim 7, wherein said inner, metallic core comprises steel.

9. The caisson in accordance with claim 5, the cross sectional area of said inner, metallic core of said caisson being at least 29% of the total cross sectional area and the cross sectional area of said outer portion being less than 71% of said total cross sectional area of said caisson.

10. The caisson in accordance with claim 9, said inner, metallic core of said caisson comprising steel.

11. The caisson in accordance with claim 10, further comprising a hollow, uninterrupted, cylindrical, steel shell surrounding the outer periphery of said outer portion of said caisson.

12. A caisson for use as a support structure in building construction, said caisson comprising:

a) a longitudinal, inner, high strength, metallic core; and b) an outer portion comprising unreinforced concrete and being directly attached to and surrounding said inner, high strength, metallic core;

the cross sectional area of said inner, high strength, metallic core of said caisson being at least 25% of the total cross sectional area of said caisson.

13. The caisson in accordance with claim 12, wherein said inner, metallic core comprises high strength steel.

14. The caisson in accordance with claim 12, wherein the cross sectional shape of said inner, metallic core is chosen from the group: circles, ellipses, stars, regular polygons, irregular polygons, symmetric shapes and asymmetric shapes.

15. The caisson in accordance with claim 14, wherein the cross sectional shape of said outer portion is chosen from the group: circles, ellipses, stars, regular polygons, irregular polygons, symmetric shapes and asymmetric shapes.

16. The caisson in accordance with claim 14, wherein the cross sectional area of said inner, metallic core is over 10% of said total cross sectional area of said caisson.

17. The caisson in accordance with claim 12, wherein the cross sectional shape of said outer portion is chosen from the group: circles, ellipses, stars, regular polygons, irregular polygons, symmetric shapes and asymmetric shapes.

18. The caisson in accordance with claim 17, wherein the cross sectional area of said inner, metallic core is over 10% of said total cross sectional area of said caisson.

19. The caisson in accordance with claim 12, further comprising:

c) at least one metallic band disposed peripherally around said inner, metallic core for anchoring said inner, metallic core to said outer portion of said caisson.

* * * * *